US005528207A

United States Patent [19]

Ito

[11] Patent Number: 5,528,207

[45] Date of Patent: Jun. 18, 1996

[54] DIELECTRIC FILTER FOR MOUNTING TO A PRINTED CIRCUIT BOARD

[75] Inventor: Kenji Ito, Nagoya, Japan

[73] Assignee: NGK Spark Plug Co., Ltd., Aichi-ken, Japan

[21] Appl. No.: 312,755

[22] Filed: Sep. 27, 1994

[30] Foreign Application Priority Data

Sep. 28, 1993 [JP] Japan ..... 5-057156 U

[51] Int. Cl.[6] ..... H01P 1/205

[52] U.S. Cl. ..... 333/206; 333/222

[58] Field of Search ..... 333/202, 203, 333/206, 207, 222, 223

[56] References Cited

U.S. PATENT DOCUMENTS 4,431,977 2/1984 Sokola et al. ..... 333/206

5,208,566 5/1993 Kenoun et al. ..... 333/206

FOREIGN PATENT DOCUMENTS 60301 2/1990 Japan ..... 333/202 DB

*Primary Examiner*—Paul Gensler

*Attorney, Agent, or Firm*—Larson and Taylor

[57] ABSTRACT

A dielectric filter includes a dielectric block having through bores running from an end face to the opposite face thereof and grooves arranged between adjacent through bores on a side thereof. The opposite side of the dielectric filter is uniformly flat and free of grooves so that the dielectric block may be suspended, moved and easily mounted on a printed-circuit board by means of a suction pad having a large effective sucking area.

2 Claims, 3 Drawing Sheets

DIELECTRIC FILTER FOR MOUNTING TO A PRINTED CIRCUIT BOARD

BACKGROUND OF THE INVENTION

This invention relates to a dielectric filter having a configuration particularly suited for mounting it on a printed-circuit board. Such a dielectric filter can suitably be used for telecommunications equipment such as a portable telephone or mobile telephone.

FIGS. 1, 2 and 3 of the accompanying drawings illustrate a known interdigital tripole type dielectric filter comprising a substantially rectangularly parallelepipedic dielectric block 1 typically made of a ceramic material, through which a total of three holes 2*a* through 2*c* are bored from an end face to the opposite face. The through bores 2*a* through 2*c* are provided on the inner peripheral surface with respective internal conductors 3*a* through 3*c*, while an external conductor 4 is arranged on a lateral side of the dielectric block 1. Said oppositely disposed end faces of the dielectric block 1 carrying the openings of the through bores are divided into conductive short-circuiting surface sections 5*a* through 5*c* for electrically connecting respective ends of said internal conductors 3*a* through 3*c* and the external conductor 4 and open-circuiting surface sections 6*a* through 6*c* for electrically insulating the respective other ends of the inner conductors 3*a* through 3*c* from the external conductor 4, said surface sections 5*a* through 5*c* and 6*a* through 6*c* being interdigitally arranged in a manner as illustrated in FIGS. 1 and 2. A pair of L-shaped input/output terminals 7*a* and 7*b* are arranged on a side of the dielectric block 1 and electrically connected with the corresponding extreme through bores 2*a* and 2*b* via conductive holes 8*a* and 8*b* respectively and straight grooves 9*a* through 9*d* are formed on a pair of oppositely disposed sides or top and bottom sides of the dielectric block 1 between any two adjacent through bores, running in parallel with the through bores between said opposite end faces. The grooves 9*a*, 9*c* and 9*d* are arranged to regulate the degree of interstage coupling of the internal conductors 3*a* through 3*c* that operates as resonators.

The dielectric filter having a configuration as described above is then arranged on a printed-circuit board p as illustrated in FIG. 3 and soldered to the latter at m1 and m2, the input/output terminals 7*a* and 7*b* being respectively connected to input/output circuits s1 and s2.

For mounting such a conventional dielectric filter on a printed-circuit board p, as shown in FIG. 3, a suction pad t connected to a suction pump (not shown) is applied to the top (the side opposite to the one where the input/output terminals are arranged) of the dielectric filter to suspend the dielectric filter and move it onto the printed-circuit board until it is aligned with the input/output circuits of the circuit board, when the dielectric filter is released from the suction pad.

With such an arrangement, the suction pad needs to have a width equal to or smaller than the distance separating the two grooves 9*c* and 9*d* on the top of the dielectric block so that it may be brought to abut the narrow area between the two grooves to lift the dielectric block. This is because, if the suction pad t has a width greater than the distance between the grooves to cover the latter, air can easily come into the suction pad through the grooves to make it inoperative.

Thus, because of the relatively small effective area of the suction pad of a conventional system of mounting a dielectric filter on a printed-circuit board, the filter can drop from the suction pad to destroy itself by its own weight while it is being moved to the printed-circuit board and it is often difficult to place the suction pad precisely on the narrow inter-groove area of a dielectric filter.

It is therefore an object of the present invention to solve the above identified problems and thus to provide a dielectric filter that can be easily and securely mounted on a printed-circuit board.

SUMMARY OF THE INVENTION

According to the invention, there is provided a dielectric filter comprising a dielectric block having a plurality of through bores and carrying internal conductors arranged respectively on the inner peripheral surfaces of the through bores, an external conductor on a lateral side thereof, input/output terminals on a side thereof and parallel grooves arranged on said side thereof between two adjacent through bores for regulating the degree of interstage coupling, said dielectric block being secured to a printed-circuit board with its input/output terminals connected with corresponding input/output circuits of the printed-circuit board, characterized in that the side of said dielectric block opposite to the side beating the input/output terminals is uniformly flat and free of grooves for regulating the degree of interstage coupling.

Preferably, each of the grooves for regulating the degree of interstage coupling arranged on a side of the dielectric block may have a depth not greater than four-fifth of the height of the dielectric block.

Since a dielectric filter having a configuration as described above has a uniformly flat side that is free of grooves for regulating the degree of interstage coupling through which air can flow, a suction pad having a large effective sucking area can be used to lift the dielectric block to enhance the efficiency of the operation of lifting, moving and placing in position the dielectric block.

Now, the present invention will be described in more detail by referring to the accompanying drawings that illustrate a preferred embodiment of the invention.

DETAILED DESCRIPTION OF THE INVENTION

Figure 1:
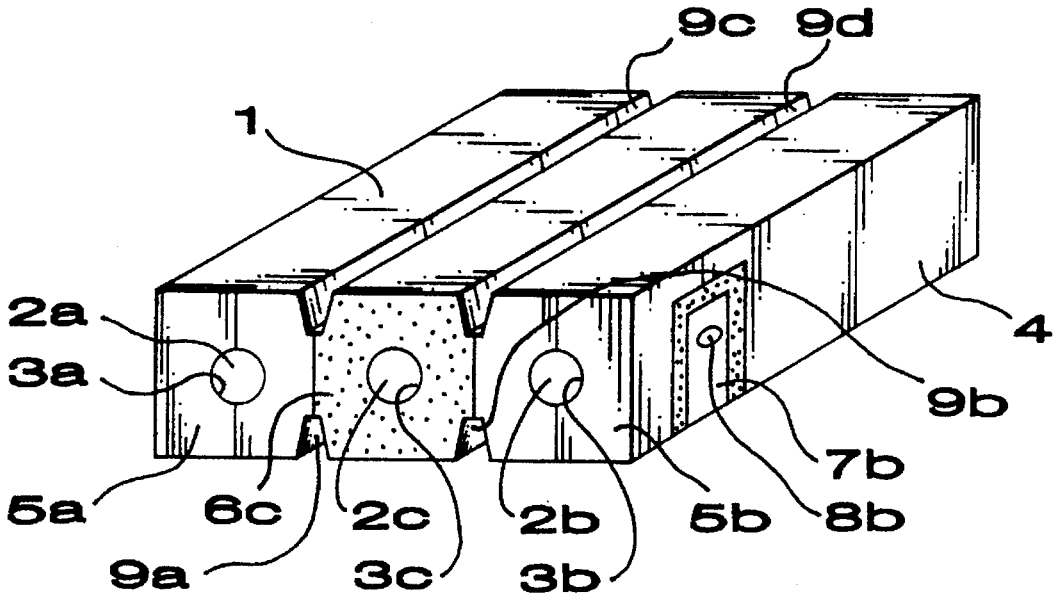
FIG. 1 PRIOR ART
FIG. 1 is a schematic perspective view of a conventional dielectric filter.
Figure 2:
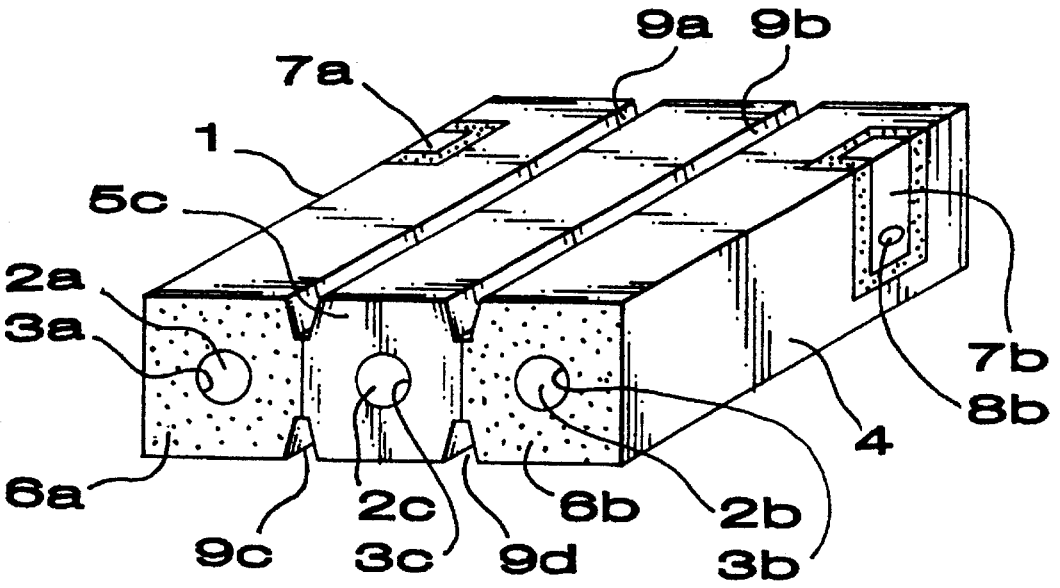
FIG. 2 PRIOR ART
FIG. 2 is a schematic perspective view of the dielectric filter of FIG. 1 as viewed when it is turned upside down and backwards.
Figure 3:
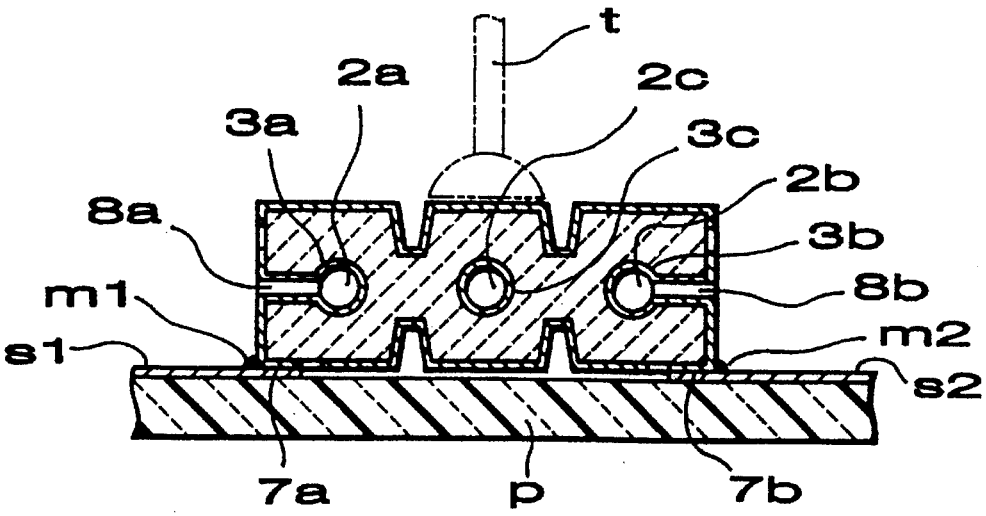
FIG. 3 PRIOR ART
FIG. 3 is a schematic sectional side view of the dielectric filter of FIG. 1 as viewed when it is a mounted on a printed-circuit board.
Figure 6:
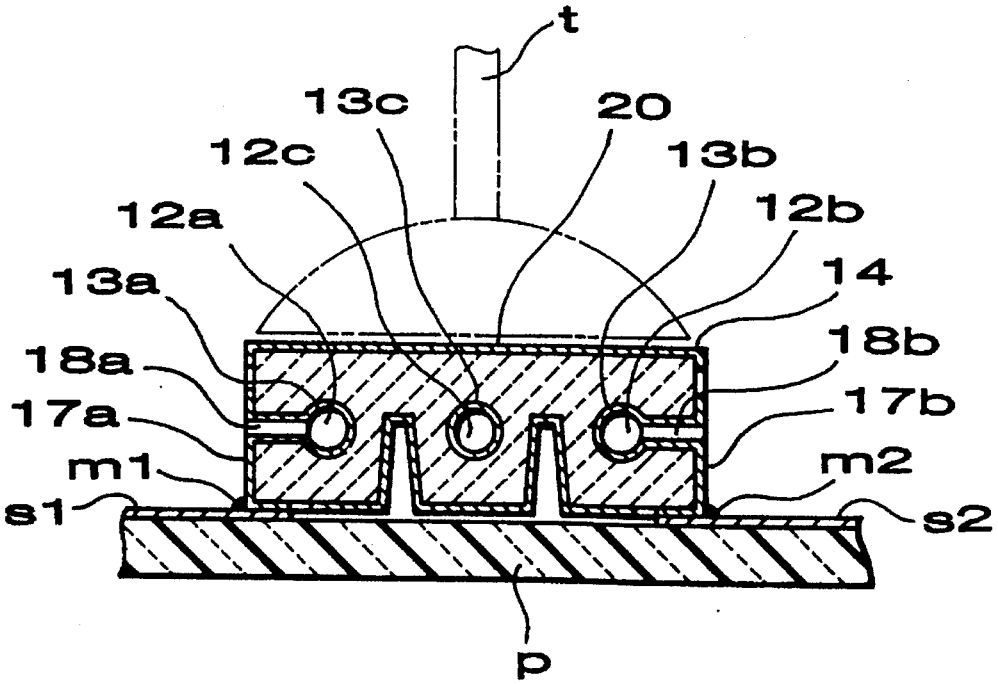
FIG. 6 is a schematic sectional side view of the embodiment of FIG. 4 as viewed when it is mounted on a printed circuit board.
Figure 4:
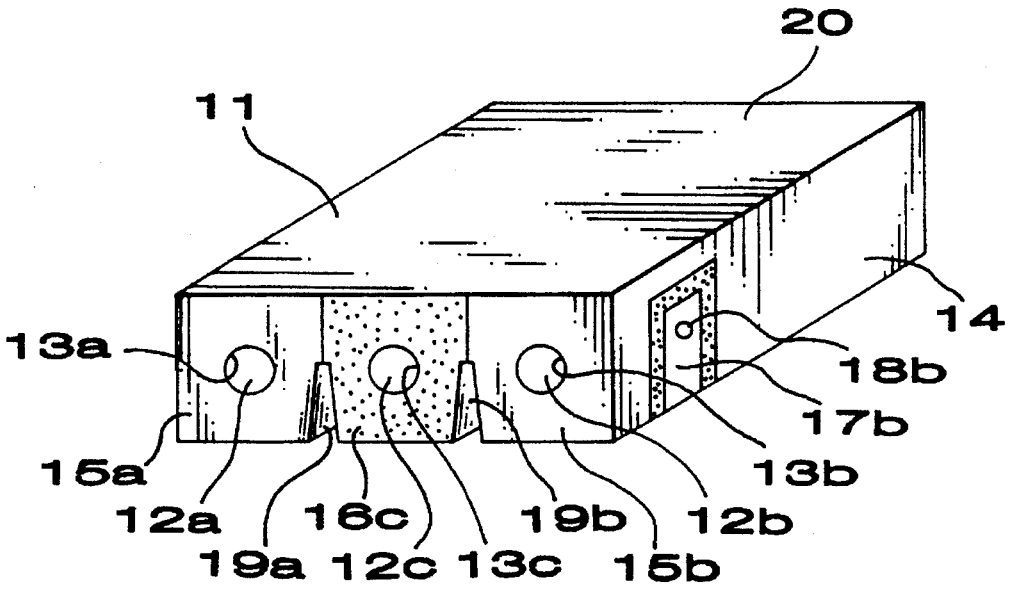
FIG. 4 is a schematic perspective view of an embodiment of a dielectric filter according to the invention.
Figure 5:
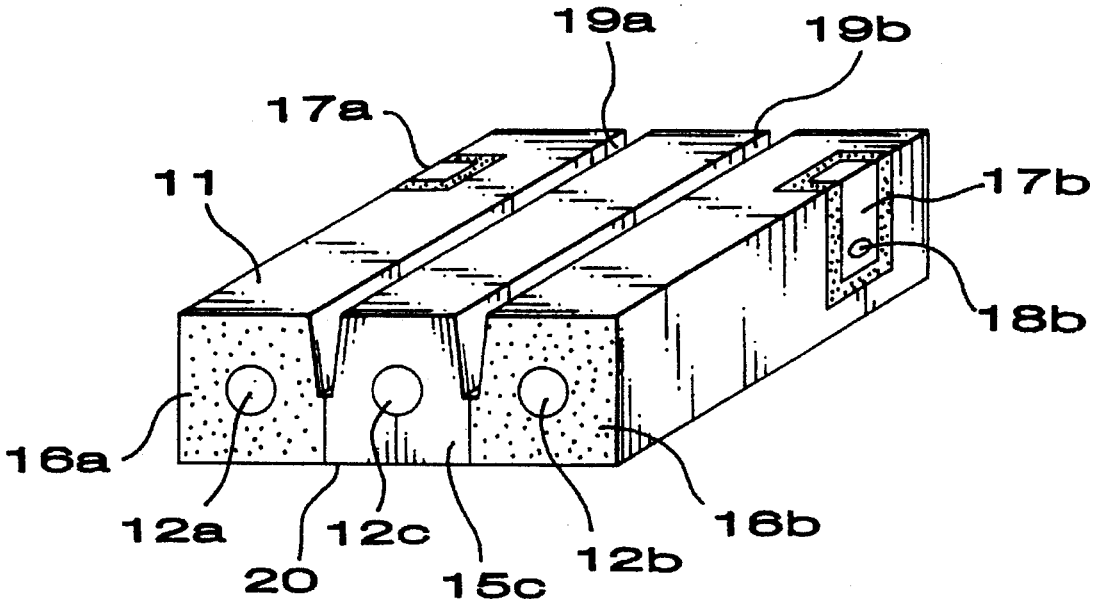
FIG. 5 is a schematic perspective view of the embodiment of FIG. 4 as viewed when it is turned upside down and backwards.

Referring to FIGS. 4, 5 and 6 illustrating a preferred embodiment of a dielectric filter according to the invention, the embodiment comprises a dielectric block 11, through which a plurality of holes 12*a*, 12*b* and 12*c* are bored from an end face to the opposite face, said through bores 12*a* through 12*c* being designed to operate as so many resonators. The inner peripheral surfaces of the through bores 12*a* through 12*c* are covered with respective internal conductors 13*a*, 13*b* and 13*c* and an external conductor 14 is arranged on a lateral side of the dielectric block 11. The dielectric filter further comprises short-circuiting surface sections 15*a*, 15*b* and 15*c* and open-circuiting surface sections 16*a*, 16*b* and 16*c* that are interdigitally arranged in a manner as illustrated in FIGS. 4 and 5. A pair of L-shaped input/output terminals 17*a* and 17*b* are arranged on a side of the dielectric block 11 and electrically connected with the corresponding extreme through bores 12*a* and 12*b* via conductive holes 18*a* and 18*b* respectively. While the above described configuration of the dielectric filter is the same as that of the conventional dielectric filter described earlier by referring to FIGS. 1 and 2, this embodiment differs from the conventional filter in that only a side (the side to be placed vis-a-vis the printed-circuit board as shown in FIG. 6) thereof is provided with grooves 19*a* and 19*b* for regulating the degree of interstage coupling of the internal conductors 13*a* through 13*c* that operate as resonators and the opposite side 20 is made flat and free of grooves.

With such an arrangement, the embodiment is firstly lifted with the flat side 20 and the opposite side having grooves 19*a* and 19*b* respectively facing upward and downward by means of a suction pad having a large effective sucking area and moved on a printed-circuit board p until it is placed in position as shown in FIG. 6, when the input/output terminals 17*a* and 17*b* are secured to and connected with the corresponding input/output circuits s1 and s2 of the printed-circuit board p by means of solders m1 and m2 respectively.

While the depth of each of the grooves 19*a* and 19*b* is so controlled as to be optimally adapted to regulate the degree of interstage coupling between two adjacent internal conductors, its maximum depth does not exceed four-fifth of the height of the dielectric block. If the depth is greater than the above defined extent, it can adversely affect the mechanical strength of the dielectric block 11 and make it liable to be damaged during handling.

While the above described embodiment is directed to an interdigital tripole type dielectric filter, the present invention is not limited thereto and any number of through bores (internal conductors) that is equal to or greater than two is compatible with the present invention. Alternatively, a dielectric filter according to the invention may be realized in the form of a comb type filter, where each of a plurality of internal conductors is short-circuited via an end thereof by means of a conductor arranged on an end face of the dielectric block of the filter.

Since the dielectric block of a dielectric filter according to the invention has a flat side that is free of grooves, a suction pad having a large effective sucking area and hence a large suction power can be used for lifting it so that the block may not be inadvertently dropped during transportation and can be mounted on a printed-circuit board in a secured manner. Additionally, since a suction pad does not need to be precisely fitted to a given area of the surface of the dielectric block, the overall operation of lifting the block and placing it in position on a printed-circuit board is greatly simplified and dielectric filters of the type under consideration can be manufactured on a large scale to reduce the manufacturing cost.

I claim:

1. A dielectric filter comprising a dielectric block having a plurality of through bores from one end to an opposite end and carrying internal conductors arranged respectively on the inner peripheral surfaces of the through bores, an external conductor on a lateral side of said block, input/output terminals on a bottom side of said block, and parallel grooves arranged on said bottom side of said block between two adjacent through bores for regulating the degree of interstage coupling, said dielectric block being secured to a print-circuit board with its input/output terminals connected with corresponding adjacent input/output circuits of the printed-circuit board, characterized in that a top side of said dielectric block opposite to the bottom side bearing the input/output terminals is uniformly flat and free of grooves for regulating the degree of interstage coupling.

2. A dielectric filter as claimed in claim 1, wherein each of the grooves for regulating the degree of interstage coupling arranged on the bottom side of the dielectric block has a depth not greater than four-fifth of the height of the dielectric block.

* * * * *